US009568243B2

(12) United States Patent
Liu et al.

(10) Patent No.: US 9,568,243 B2
(45) Date of Patent: Feb. 14, 2017

(54) CONTINUOUS MICROWAVE FREEZE-DRYING DEVICE

(75) Inventors: Chaohui Liu, Leshan (CN); Chuan Zhou, Leshan (CN); Yi Liu, Leshan (CN); Qi Kang, Leshan (CN); Jun You, Leshan (CN); Kun Zhou, Leshan (CN)

(73) Assignee: SICHUAN HOPE MICROWAVE SCIENCE & TECHNOLOGY CO., LTD., Leshan, Sichuan (CN)

( * ) Notice: Subject to any disclaimer, the term of this patent is extended or adjusted under 35 U.S.C. 154(b) by 492 days.

(21) Appl. No.: 13/990,767

(22) PCT Filed: Jun. 15, 2011

(86) PCT No.: PCT/CN2011/000995

§ 371 (c)(1),
(2), (4) Date: May 30, 2013

(87) PCT Pub. No.: WO2012/167404

PCT Pub. Date: Dec. 13, 2012

(65) Prior Publication Data

US 2013/0333237 A1 Dec. 19, 2013

(30) Foreign Application Priority Data

Jun. 9, 2011 (CN) ..... 2011 1 0153958

(51) Int. Cl.

| | |
|---|---|
| ***F26B 3/347*** | (2006.01) |
| ***F26B 5/06*** | (2006.01) |
| *F26B 5/04* | (2006.01) |

(52) U.S. Cl.
CPC ..... *F26B 3/347* (2013.01); *F26B 5/048* (2013.01); *F26B 5/06* (2013.01); *F26B 5/042* (2013.01)

(58) Field of Classification Search
CPC ..... F26B 3/347; F26B 5/042; F26B 5/048; F26B 5/06
See application file for complete search history.

(56) References Cited

U.S. PATENT DOCUMENTS 3,902,452 A * 9/1975 Queen ..... D06N 7/0071 118/236
4,204,336 A * 5/1980 Le Viet ..... F26B 5/06 219/686

(Continued)

FOREIGN PATENT DOCUMENTS

CN 2870478 Y 2/2007
CN 200979336 Y 11/2007

(Continued)

*Primary Examiner* — Jiping Lu
(74) *Attorney, Agent, or Firm* — Novick, Kim & Lee, PLLC; Allen Xue

(57) ABSTRACT

A continuous microwave freeze-drying device comprises a vacuum water-trapping system (1), a microwave shield plate (2), a microwave bin (6) and a freeze-drying bin (5) located in the microwave bin (6), wherein the freeze-drying bin (5) comprises an upper bin opening, a left bin wall, a right bin wall and a bottom bin wall, and the left, right and bottom bin walls are all made from nonmetal wave transmitting materials, such as polyfluortetraethylene, polyethylene, polypropylene or quartz glass. The device solves the technical problem of freeze-drying failure caused by glow discharge of microwave under freeze-drying environment.

9 Claims, 2 Drawing Sheets

(56) References Cited

U.S. PATENT DOCUMENTS

| | | | | |
|---|---|---|---|---|
| 4,664,924 | A * | 5/1987 | Sugisawa | F26B 5/048 219/734 |
| 6,486,073 | B1 * | 11/2002 | Nakamura | G03F 7/427 257/E21.249 |
| 7,007,405 | B2 * | 3/2006 | Hajek | F26B 3/347 34/259 |

FOREIGN PATENT DOCUMENTS

| | | | |
|---|---|---|---|
| CN | 101608862 | A | 12/2009 |
| CN | 101922855 | A | 12/2010 |
| CN | 102200372 | A | 9/2011 |
| JP | 57026380 | A | 2/1982 |

* cited by examiner

CONTINUOUS MICROWAVE FREEZE-DRYING DEVICE

FIELD OF TECHNOLOGY

The invention relates to the technical field of freeze-drying equipment, in particular to a continuous freeze-drying device using microwave as a heat source.

BACKGROUND

Freeze-drying technology is a process by which moisture contained in a moisture-containing material is frozen to be discharged after being directly transformed from solid phase into gas phase so as to obtain a dry product, also known as lyophilization. Hot plates or infrared radiation plates are generally used for providing sublimation heat in traditional freeze-drying methods, traditional freeze-drying methods are widely applied to food, medicine and new material processing fields, but severely restrict further development of freeze-drying technologies due to their low drying rate, long cycle, complex equipment, high manufacturing cost and huge power consumption.

Microwave freeze-drying is a new technology combining high-efficiency microwave radiation heating technology and vacuum freeze-drying technology, allows water molecules of the material to vibrate and rub against each other under the action of a microwave field by 3D heating characteristic of microwave, thus converting electric energy into latent sublimation heat for moisture sublimation. Compared with traditional freeze-drying methods, the biggest advantages of microwave freeze-drying include quick drying speed and high thermal efficiency, and the freeze-drying speed is 4-20 times of that of a conventional heating method.

The major technical problem of the microwave freeze-drying technology is glow discharge of microwave under vacuum environment, vacuum pressure for freeze-drying is generally at 1-610 Pa, and the vacuum pressure is the pressure range in which disruptive discharge easily occurs in the microwave field. In practical application, glow discharge of microwave frequently occurs in the freeze-drying bin, resulting in gas ionization in the freeze-drying bin, thus causing harmful material change, effective heating power loss of microwave and freeze-drying failure. No large-scale industrial application of microwave freeze-drying technology is found at home and abroad through literature retrieval.

The Chinese invention patent application 200910181720.1 titled "Double-bin differential pressure microwave vacuum freeze-drying device" with publication No. of 101608862 and publication date of Dec. 23, 2009 discloses a microwave freeze-drying device, a freeze-drying bin thereof is separated into a first bin and a second bin by a transmitting baffle wall, and a magnetron is located in the first bin, with relative vacuum degree smaller than discharge critical value, and a material loading device is located in the second bin and connected with a cold trap by a shield overflow plate. The second bin is also a vacuum space, frequent discharge of microwave still occurs in the space, the method only helps reduce the probability of glow discharge, practices show that the simple method of separating the freeze-drying bin into two bins of different pressures can not fundamentally prevent occurrence of vacuum discharge, can not be used under industrial environment, and has difficulty in implementation.

The Chinese invention patent application 200910059544.4 titled "Continuous microwave freeze-drying system" with publication No. of 101922855A and publication date of Dec. 22, 2010 discloses a continuous microwave freeze-drying device using a combined microwave freeze-drying bin. The invention comprises a microwave vacuum freeze-drying device, a vacuum water-trapping device, a vacuum feed device and a vacuum discharge device, the microwave vacuum freeze-drying device is provided with a combined freeze-drying bin consisting of an atmospheric microwave chamber and a vacuum microwave chamber, the atmospheric microwave chamber is separated from the vacuum microwave chamber by a microwave transmitting vacuum baffle plate, the vacuum microwave chamber and the vacuum water-trapping device is connected by a vapor channel, and the vacuum microwave chamber is separated from the vapor channel by a porous ventilating microwave shield plate. The technology core is to separate the freeze-drying bin into the atmospheric microwave chamber and the vacuum microwave chamber by a microwave transmitting material to solve easy discharge of microwave under vacuum environment. Experiments show that the method of separating the freeze-drying bin into the vacuum bin and the atmospheric microwave bin by a microwave transmitting material reduces the probability of discharge to some extent. However, as the freeze-drying bin is only separated by the microwave transmitting material, that is, one wall of the freeze-drying bin is a metal conducting plate, two walls are metal plates and another wall is of microwave transmitting material, in this way, microwave is reflected by three metal bin walls of the freeze-drying bin under vacuum environment, thus resulting in non-uniform microwave field, non-uniform drying of materials, low product yield and poor quality. Meanwhile, the feed belt and the return belt of the belt conveying system are located in the freeze-drying bin, increasing manufacturing difficulty and cost, and making operational failure rate high and implementation difficult.

DESCRIPTION OF THE INVENTION

In order to solve the technical problem, the invention provides a continuous microwave freeze-drying device, and helps to solve the technical problem of freeze-drying failure caused by glow discharge of microwave under freeze-drying environment so as to allow microwave to be actually used in freeze-drying industrial environment. Meanwhile, the invention realizes non-reflection of microwave by freeze-drying bin walls under vacuum environment, more uniform microwave field in a freeze-drying bin, high freeze-drying yield and excellent quality.

The invention is realized by the following technical solutions:

A continuous microwave freeze-drying device, comprising a freeze-drying bin, a microwave shield plate, a vacuum water-trapping system and a microwave bin, and characterized in that the freeze-drying bin comprises an upper bin opening, a left bin wall, a right bin wall and a bottom bin wall, and the left, right and bottom bin walls are all made from nonmetal wave transmitting materials such as polyfluortetraethylene, polyethylene, polypropylene or quartz glass.

The microwave shield plate is connected to the upper bin opening of the microwave bin to form a bin wall of the microwave bin.

The freeze-drying bin is located in the microwave bin, and the upper bin opening of the freeze-drying bin is connected with the microwave shield plate.

The microwave shield plate is provided with multiple ventilation through holes, and the freeze-drying bin is connected with the vacuum water-trapping system through the microwave shield plate.

A section of the freeze-drying bin takes a "concave" shape, and the concave top is the upper bin opening.

Internal space volume size of the freeze-drying bin accounts for 30%-65% of external volume size of the whole freeze-drying bin.

Internal material volume of the freeze-drying bin accounts for 35%-90% of internal space volume of the whole freeze-drying bin.

The continuous microwave freeze-drying device further comprises a material conveying belt, the material conveying belt is a PTFE glass fiber conveying belt, the PTFE glass fiber conveying belt is a mesh belt or nonporous or porous flat belt, a feed belt of the material conveying belt is installed in the freeze-drying bin, and a return belt returns from the exterior.

The continuous microwave freeze-drying device further comprises a continuous vacuum feed mechanism and a continuous vacuum discharge mechanism.

The continuous microwave freeze-drying device operates as follows:

A frozen material to be freeze-dried is continuously sent into a material conveying system of the concave freeze-drying bin through a continuous vacuum feed system and a microwave suppressor, meanwhile, microwave transmits into the microwave bin through a microwave feed inlet, passes through freeze-drying bin walls, acts on materials on t he material conveying system, and provides sublimation heat for moisture of the material. Sublimated moisture of the material enters the vacuum water-trapping system via through holes on the microwave shield plate, thus completing freeze-drying, and then the dried material is continuously discharged through the microwave suppressor and the continuous vacuum discharge system.

Compared with the prior art, the invention has the following benefits:

1. The left, right and bottom bin walls of the freeze-drying bin are all made from nonmetal wave transmitting materials, characterized by easy processing and manufacturing and excellent vacuum tightness, and can solve glow discharge of microwave under vacuum environment without destroying environment for freeze-drying. Three walls of the freeze-drying bin are made from nonmetal wave transmitting materials, thus realizing non-reflection of microwave by freeze-drying bin walls under vacuum environment, more uniform microwave field in the freeze-drying bin, high freeze-drying yield and excellent quality, and unexpected technical effects are made compared with the prior art.

2. The microwave shield plate of the invention is connected to the upper bin opening of the microwave bin to form a bin wall of the microwave bin, the structural form has advantages of convenient processing and simple structure.

The freeze-drying bin is located in the microwave bin, and the upper bin opening of the freeze-drying bin is connected with the microwave shield plate, the microwave shield plate is provided with multiple ventilation through holes to suppress transmittance of microwave and ensure vapor permeation, the microwave shield plate is directly installed between the vacuum water-trapping system and the freeze-drying bin to suppress microwave to transmit into the water-trapping system and trap vapor of the freeze-drying bin by the trapping system.

3. The section of the freeze-drying bin takes a "concave" shape, repeated experiments performed on the structural form show that the "concave" shape has the best technical effect to prevent occurrence of glow discharge.

4. The internal space volume size of the freeze-drying bin accounts for 30%-65% of external volume size of the whole freeze-drying bin, and the internal material volume of the freeze-drying bin accounts for 35%-90% of internal space volume of the whole freeze-drying bin, and repeated experiments show that the volume relationship can prevent occurrence of glow discharge.

5. The material conveying belt is made from low loss microwave materials, such as PTFE glass fiber conveying belt, materials of the characteristic do not absorb microwave energy so as to ensure microwave energy to act on materials to the maximum extent.

6. The continuous vacuum feed mechanism and the continuous vacuum discharge mechanism have vacuum protection characteristic, and can continuously feed/discharge materials in/out of vacuum environment without destroying the vacuum environment.

DESCRIPTION OF FIGURES

The invention will be further described in combination with figures and preferred embodiments, and it is to be understood that the invention is not restricted thereto in any way.

In the figures: 1. vacuum water-trapping system, 2. microwave shield plate, 3. material, 4. material conveying system, 5, freeze-drying bin, 6. microwave bin, 7. microwave system, 8. microwave suppressor, 9. continuous feed system, 10. continuous discharge system.

DETAILED DESCRIPTION

Embodiment 1

As the simplest embodiment of the invention, the left, right and bottom bin walls of the freeze-drying bin are all made from nonmetal wave transmitting materials such as polyfluortetraethylene, polyethylene, polypropylene or quartz glass based on existing continuous microwave freeze-drying devices such as two existing freeze-drying devices listed in the Background.

Embodiment 2

Figure 1:
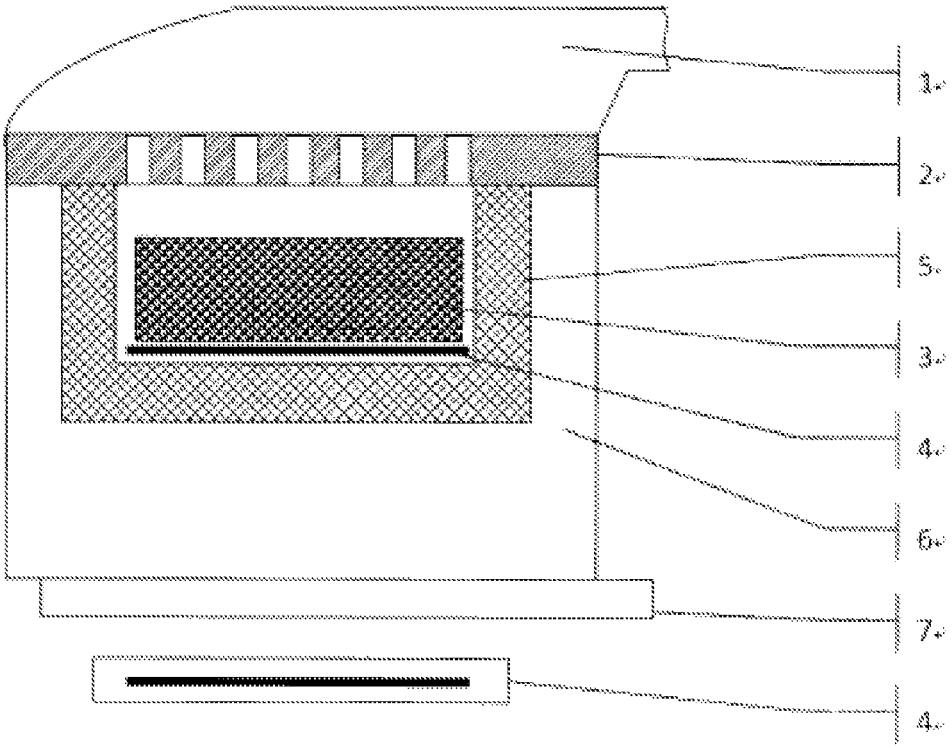
FIG. 1 is a horizontal sectional view of the device of the invention.
Figure 2:
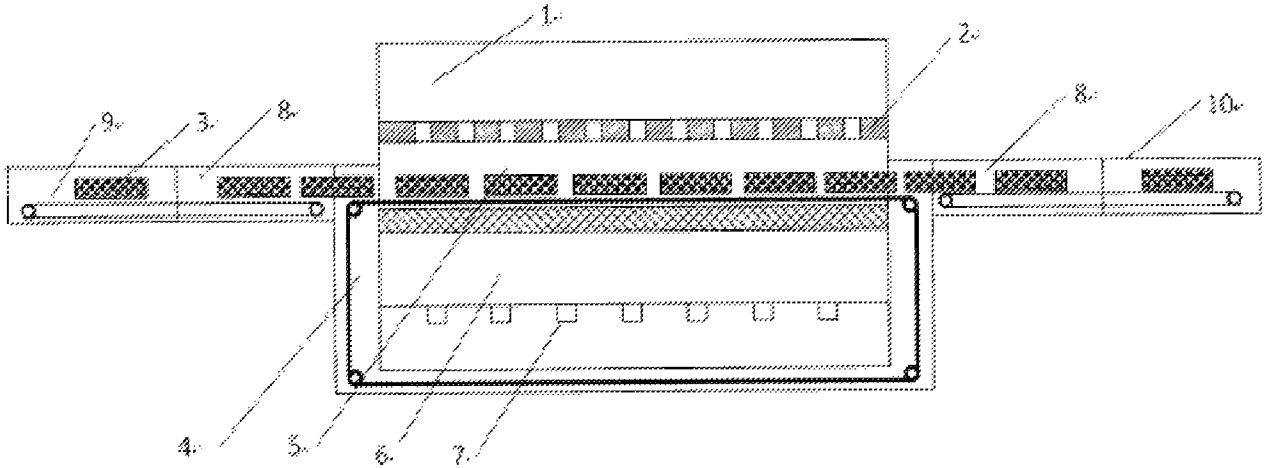
FIG. 2 is a longitudinal sectional view of the device of the invention.

As a preferred embodiment of the invention, the continuous microwave freeze-drying device is composed of a continuous vacuum feed mechanism 9, a continuous vacuum discharge mechanism 10, a microwave system 7, a microwave suppressor 8, a vacuum water-trapping system 1, a microwave bin 6, a material conveying system 4, a freeze-drying bin 5 and a microwave shield plate 2 as shown in FIG. 1 and FIG. 2.

The freeze-drying bin 5 is made from non-toxic and odor-free nonmetal microwave transmitting materials (e.g. polyfluortetraethylene) with certain strength, wave transmittance, low microwave loss and certain temperature resistance;

The microwave shield plate 2 is made from metals, and provided with uniform through holes to suppress transmittance of microwave and ensure vapor permeation;

The section of the freeze-drying bin 5 takes a "concave" shape, is provided with the microwave shield plate 2 and connected with the vacuum water-trapping system 1;

The freeze-drying bin 5 is installed in the microwave bin 6 and connected by the microwave shield plate 2, i.e., the microwave shield plate 2 forms a bin wall oft he microwave bin 6;

A microwave feed inlet of the microwave system 7 is installed on a bin wall of the microwave bin 6, namely, a bin wall without the microwave shield plate 2;

The material conveying system 4 uses continuous circulating conveying belts (e.g. PTFE glass fiber conveying belt) made from non-toxic and odor-free materials with low microwave loss;

The feed belt of the material conveying system 4 is installed in a concave groove of the freeze-drying bin 5, the return belt does not return through the freeze-drying bin 5 and returns from the exterior;

The continuous vacuum feed system and the continuous vacuum discharge system have vacuum protection characteristic, and can continuously feed/discharge materials in/out of the vacuum freeze-drying bin without destroying the vacuum environment; and The microwave suppressor 8 is of a matrix pin suppressor capable of suppressing microwave leakage and material permeation.

Embodiment 3

Continuous microwave freeze-drying device as shown in FIG. 1 and FIG. 2

The microwave system uses microwave sources with frequency of 2450 MHz by slot antenna feeding, the power of wave sources for a single device is 2 kW, and the total power of multiple devices reaches 30 kW, the freeze-drying bin 5 is made from polyfluortetraethylene, the conveying belt of the material conveying system 4 is of a PTFE coated glass fiber belt, and material 3 is a material of which 65% moisture content has been frozen below an eutectic point.

Main operational processes are as follows:

The vacuum water-trapping system 1 extracts vacuum to drop pressure of the freeze-drying bin 5 below 133 Pa;

The material 3 is continuously sent to the conveying belt of the material conveying system 4 by the continuous feed system 9 and the microwave suppressor 8;

The material system 4 continuously feeds the material 3 in the freeze-drying bin 5;

The microwave system 7 feeds microwave in the microwave bin 6, and then the microwave transmits bin walls of the freeze-drying bin 5 to provide heat for the material 3 for sublimation;

Vapor from moisture sublimation of the material 3 enters the vacuum water-trapping system 1 through the through holes on a microwave suppression plate 2, thus ensuring vacuum pressure for freeze-drying not to rise; and The dry material 3 is continuously discharged out of the freeze-drying bin 5 by the conveying belt of the material conveying system 4, and continuously discharged out of the device by the microwave suppressor 8 and the continuous discharge system 10 to obtain a freeze-dried material.

The invention claimed is:

1. A continuous microwave freeze-drying device, comprising:

a freeze-drying bin, a microwave shield plate, a vacuum water-trapping chamber, a microwave bin, and a material conveying belt, wherein the freeze-drying bin resides inside the microwave bin and is separated from the vacuum water-trapping chamber by the microwave shield plate, wherein the freeze-drying bin comprises a left bin wall, a right bin wall and a bottom bin wall, and the left, right and bottom bin walls are made from nonmetal and gas-impermeable microwave transmitting materials, wherein the microwave shield plate is a metal plate having a plurality of ventilation holes, wherein the ventilation holes allow water vapor to transfer from the freeze-drying bin to the vacuum-water trapping chamber, and wherein the material conveying belt passes through the freeze-drying bin, wherein an internal space volume of the freeze-drying bin accounts for 30%-65% of an external volume of the freeze-drying bin.

2. The continuous microwave freeze-drying device of claim 1, wherein the microwave shield plate serves as a bin wall of the microwave bin and suppresses transmittance of microwave to the vacuum-water trapping chamber.

3. The continuous microwave freeze-drying device of claim 2, wherein the microwave shield plate serves as a bin wall for the freeze-drying bin.

4. The continuous microwave freeze-drying device of claim 1, wherein the microwave transmitting materials are chosen from polyfluortetraethylene, polyethylene, polypropylene or quartz glass.

5. The continuous microwave freeze-drying device of claim 1, wherein the freeze drying bin is concave in shape and has an opening on top of the freeze drying bin.

6. The continuous microwave freeze-drying device of claim 1, characterized in that a volume of a material subject to freezing-drying inside the freeze-drying bin accounts for 35%-90% of the internal space volume of the freeze-drying bin.

7. The continuous microwave freeze-drying device of claim 1, wherein the material conveying belt is a PTFE glass fiber conveying belt.

8. The continuous microwave freeze-drying device of claim 7, wherein the PTFE glass fiber conveying belt is a mesh belt, a nonporous flat belt, or a porous flat belt.

9. The continuous microwave freeze-drying device of claim 1, further comprising a continuous vacuum feed mechanism and a continuous vacuum discharge mechanism.

* * * * *